United States Patent [19]

Reilly

[11] Patent Number: 4,704,941

[45] Date of Patent: Nov. 10, 1987

[54] GUITAR HAVING ELECTRO-LUMINESCENT LIGHT SYSTEM

[76] Inventor: Kenneth B. Reilly, 781 Delmonico St. N.E., Palm Bay, Fla. 32907

[21] Appl. No.: 862,016

[22] Filed: May 12, 1986

[51] Int. Cl.[4] ..... G10D 1/08; F21K 2/00; H01J 1/62; H05B 33/04

[52] U.S. Cl. ..... 84/464 A; 84/267; 340/781; 362/84; 362/362; 362/806; 362/811; 313/483

[58] Field of Search ..... 84/267, 464 R, 464 A, 84/477 R; 340/781; 361/424; 362/84, 362, 806–811; 313/483

[56] References Cited

U.S. PATENT DOCUMENTS

| | | | |
|---|---|---|---|
| 3,324,755 | 6/1967 | Canonico | 84/267 |
| 3,943,815 | 3/1976 | Gilbert | 84/464 A |
| 3,958,113 | 5/1976 | Termohlen | 84/464 A |
| 4,253,097 | 2/1981 | Hochstrate | 340/781 |
| 4,449,075 | 5/1984 | D'Onofrio et al. | 340/781 X |
| 4,563,933 | 1/1986 | Kim | 84/464 A |

*Primary Examiner*—W. B. Perkey

*Attorney, Agent, or Firm*—Antonelli, Terry & Wands

[57] ABSTRACT

A guitar having in the preferred embodiment a shielded electro-luminescent lamp located behind the plastic pickup guard material of the guard in a preselected configuration. The electro-luminescent lamps are encapsulated in appropriate shielding material to prevent interference with the guitar's amplifier circuitry and are driven by a shielded control circuit having a controllable flashing circuit.

31 Claims, 7 Drawing Figures

GUITAR HAVING ELECTRO-LUMINESCENT LIGHT SYSTEM

BACKGROUND OF THE INVENTION

The present invention relates to musical instruments and more particularly to a guitar having an electro-luminescent lighting system connected thereto.

Heretofore, lighting systems for musical instruments have normally contained individual light bulbs or light emitting diodes to provide the desired lighting effects. One such device is illustrated in U.S. Pat. No. 3,958,113 which contains a solid transparent plastic material having frosted surfaces to diffuse the light rays from the individual light bulbs in order to give the effect of a solid luminescent light.

Another lighting system for a guitar is illustrated in U.S. Pat. No. 3,943,185 in which the guitar contains fiber optic strands extending through the neck which conduct light from a source located in the body to front markers on the printed surface of the neck and the side surface facing the guitarist, thereby allowing the instrument to be played in the dark.

The electro-luminescent lamps contemplated for use in the present invention are presently used in military applications for the backlighting of instrument panels and displays in aircraft and dashboards.

The present invention provides for a lighting system utilizing the electro-luminescent lamps which are flat in shape and flexible to simplify the mounting and configuration of the desired emission of light and a control circuit for driving the electro-luminescent lamps.

SUMMARY OF THE INVENTION

Accordingly, one object of the present invention is to provide a novel lighting system for a guitar which takes advantage of the characteristics of electro-luminescent lamps to provide a pleasing visual effect.

It is another object of the present invention to provide a novel light system for a guitar or the like utilizing electro-luminescent lamps which enables the illumination of solid shapes, not normally obtainable with individual bulbs such as LED's.

It is another object of the present invention to provide a light system for a guitar or the like having a novel control circuit to drive the electro-luminescent lamps.

It is still another object of the present invention to provide a novel light system for a guitar or the like in which the electrical system for driving the electro-luminescent lamps does not interfere with the pickup system of the guitar.

It is still yet another object of the present invention to provide a novel light system for a guitar or the like in which the electro-luminescent lights are encapsulated in an appropriate material to prevent interference with the pickup system of the guitar.

The above and other objects of the present invention are provided by the novel apparatus which comprises in the preferred embodiment an electro-luminescent lamp mounted behind the plastic pick guard material of the guitar, the lamps being encapsulated in an indium-tin oxide material to prevent electrical interference with the pickup system of the guitar. The electro-luminescent lamp is driven by a control circuit connected to the electro-luminescent lamps by way of a shielded cable to prevent electrical interference with the musical pickup system of the guitar. This system may further include a foot control circuit enabling the musician to control the rate of flashing of the electro-luminescent lamps.

BRIEF DESCRIPTION OF THE DRAWINGS

A more complete appreciation of the invention and many of the advantages thereof may be readily obtained as the same become better understood by reference to the following detailed descriptions when considered in connection with the accompanying drawings, wherein.

DETAILED DESCRIPTION OF THE PREFERRED EMBODIMENT

Figure 1:
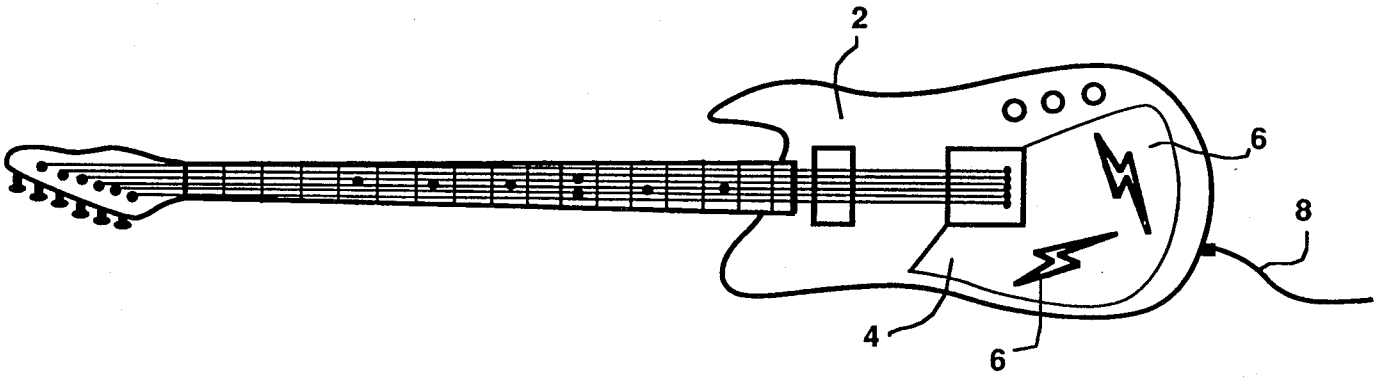
FIG. 1 is a plan view of a guitar incorporating the present invention.

Referring now to the drawings, wherein like reference numerals designate identical or corresponding parts throughout the several views, and more particularly to FIG. 1 thereof, a guitar having an electro-luminescent light system is illustrated. The guitar 2 contains the pick guard 4 which is normally made of a plastic material with an opening having the desired shape of the light cut therein. The electro-luminescent lamps 6 are adhesively connected to the back of the pick guard 4 in a position to allow the light emanating therefrom to pass through the opening in the pick guard 4. The electro-luminescent lamps 6 are connected to a control circuit (FIG. 4) which will be described in more detail hereinafter by way of the coaxial cable 8.

Figure 2:
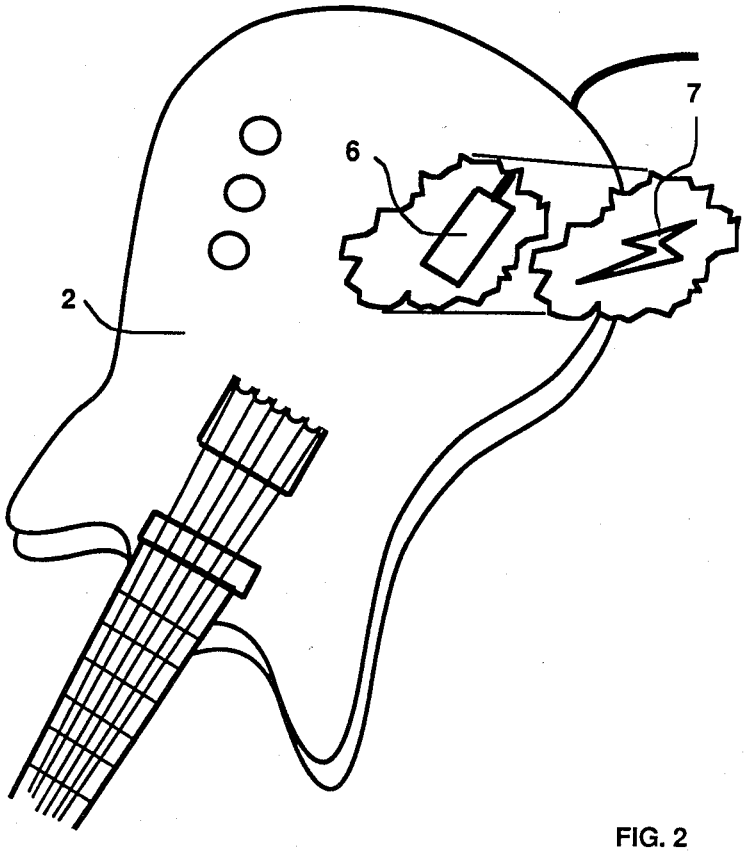
FIG. 2 is a top view of another embodiment of a guitar incorporating the present invention with a portion broken away.
Figure 3:
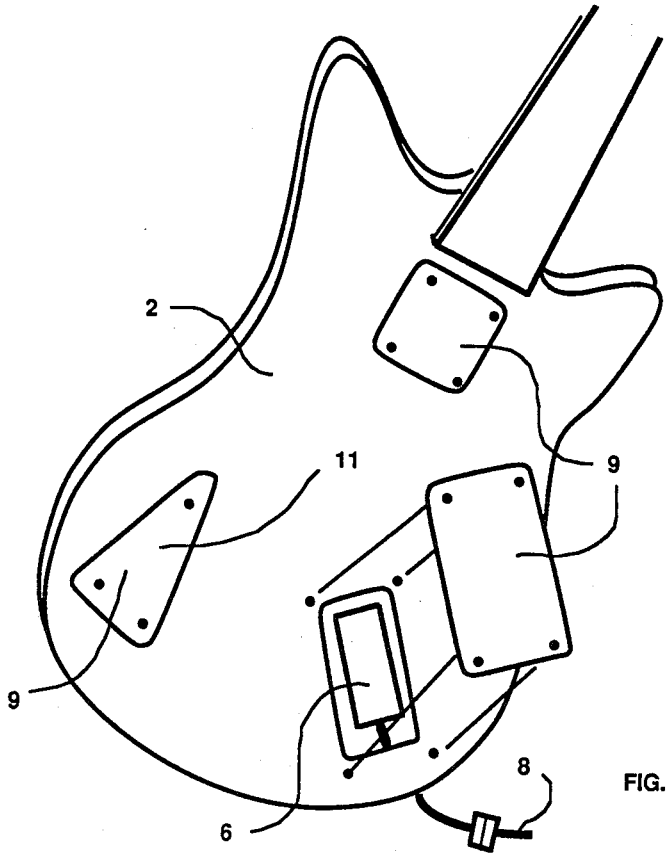
FIG. 3 is a rear view of the guitar shown in FIG. 2 with a portion exploded.

FIGS. 2 and 3 illustrate that the lamps 6 can be built into the guitar body 2 which has cutouts 7 in the desired shape for light emission. The lamps 6 are accessible by way of rear panels 9 which are mounted in this embodiment by way of the screws 11.

Figure 4:
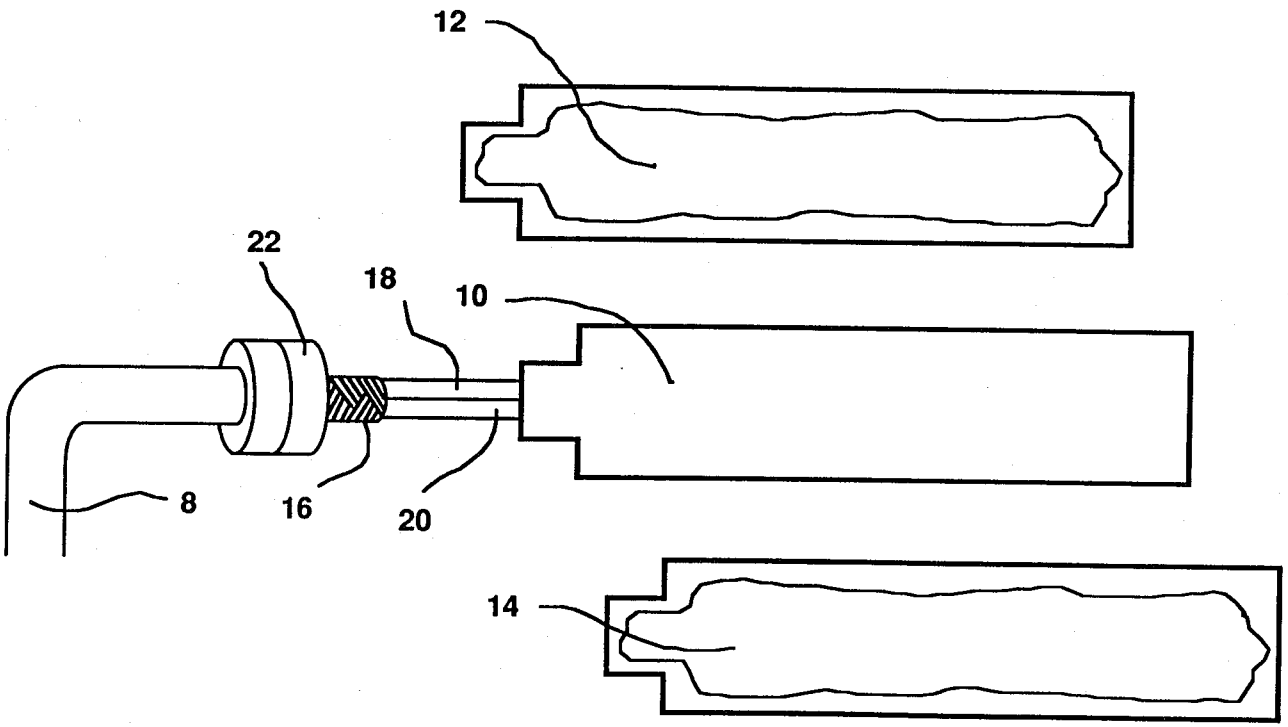
FIG. 4 is an exploded perspective view of the shielded electro-luminescent lamp according to the present invention.

Referring now to FIG. 4, an exploded perspective view of the electro-luminescent lamps 6 of the present invention is illustrated. The electro-luminescent lamp system 6 is comprised of an electro-luminescent lamp 10 and sandwiched between two layers of glass 12 and 14, respectively, which have indium-tin oxide on the inside surfaces thereof. A conductive epoxy such as that sold under the trademark Epoxy Solder, Conductive, Rigid, Part No. 72-08116, manufactured by Tecknit Corporation, having a silver base representing approximately 50% percent of epoxysilver compound, is applied around the edges of the lamp 10 and around the edges of the glass layers 12 and 14 to provide a complete conductive shield around the electro-luminescent lamp 10 when the layers 12 and 14 are compressed together. It should be further understood that the shield formed by the layers 12 and 14 is also connected to the metallic braid 16 which is used to surround the electro-luminescent lamp 10 and conductor leads 18 and 20 for additional shielding. Lead conductors 18 and 20 are connected to a shielded connector 22 connecting the coaxial cable 8 to the control circuit for the lamps 10.

In an alternative embodiment, the electrically conductive material can be of the following grou of shielding windows:

(1) A laminated conductive screen between optically clear plastic or glass sheets;

(2) A conductive screen cast within a plastic sheet;

(3) An optically clear conductive layer applied to a transparent substrate; or any similar material.

Figure 5:
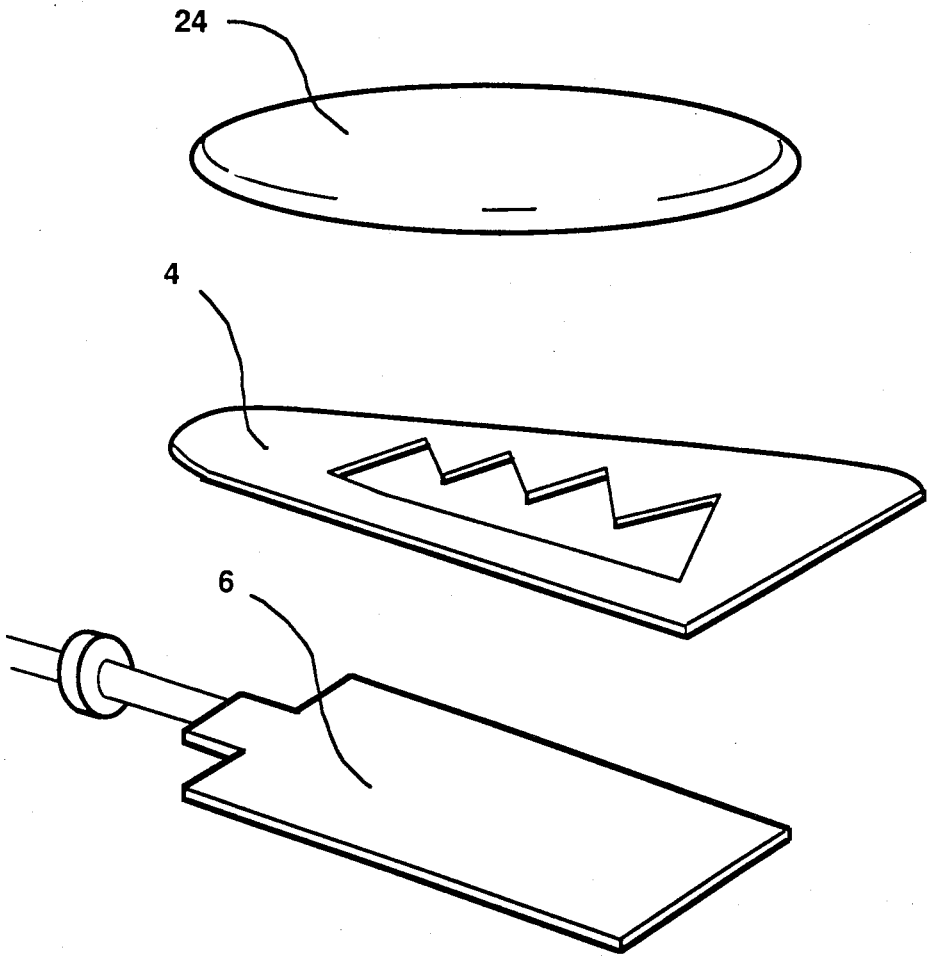
FIG. 5 is an exploded cross sectional view of the light system of FIG. 1.

Referring now to FIG. 5, an alternate embodiment of the invention illustrates a Fresnel lens 24 may be fixed to the plastic pick guard 4 directly over the electro-luminescent lamp system 6 to concentrate the light output in a single direction. Thus, the lamp intensity will appear brighter when viewed from the correct angle.

Figure 6:
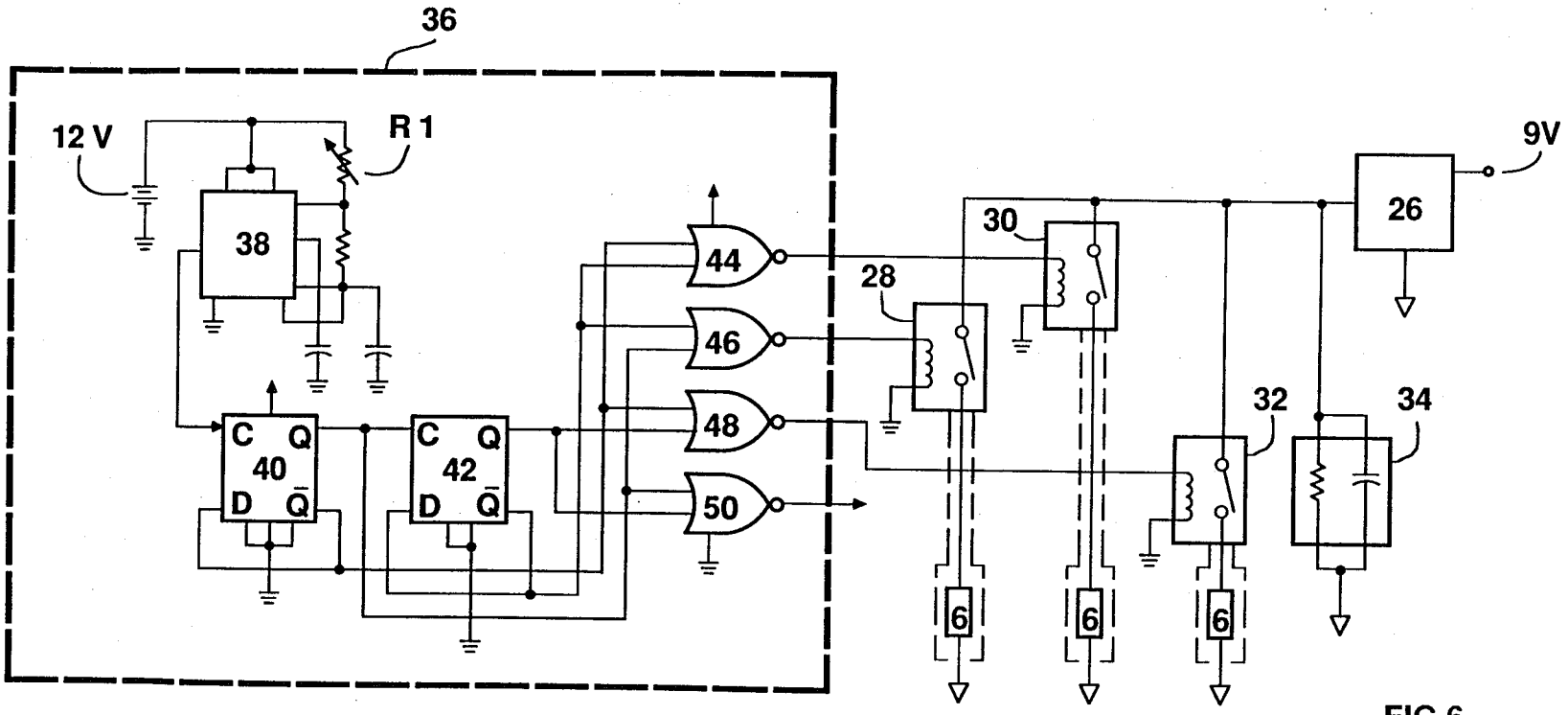
FIG. 6 is a schematic diagram of the control circuit for the electro-luminescent light system in accorance with the present invention.

Referring now to FIG. 6, the control circuit for driving the electro-luminescent lamp system 6 is illustrated. The preferred embodiment utilizes a nine volt DC source input to the inverter 26 for generating a constant AC output voltage. The output voltage from the inverter 26 drives the electro-luminescent lamp system 6 through the relays 28, 30 and 32. It should be further understood that a dummy load 34, may be required depending on the selected lamp size. The inputs to the relays 28, 30 and 32 are connected to the flasher circuit 36. The flasher circuit 36 includes an oscillator 38 in the preferred embodiment a 555 oscillator chip, manufactured by Motorola Corporation, driven by the 12 volt voltage source. The oscillation rate of the oscillator 38 is controlled by the potentiometer R1 which in the preferred embodiment is a foot operated volume pedal. The output of the oscillator 38 is connected to the input of the flip-flop 40 which in the preferred embodiment is a 4013 data flip-flop manufactured by Motorola Corporation. The Q output of the flip-flop 40 is connected to the clock input of a second flip-flop 42 which is also a 4013 data flip-flop in the preferred embodiment. The $\overline{Q}$ output of the flip-flop 40 is connected to the respective inputs of the gates 44 and 48. The Q output of the flip-flop 40 is connected to the respective inputs of the gates 46 and 50. The Q output of the second flip-flop 42 is connected to respective inputs of the gates 48 and 50, while the $\overline{Q}$ outputs of the flip-flop 42 are connected to respective inputs of the gates 44 and 46. Thus, the combination of the flip-flops 40, 42 and the gates 44, 46, 48, and 50 provide for a 1–4 sequencer circuit with the output from the two flip-flops 40 and 42 being decoded by the gates 44 through 50 for the desired count before recycling. The output from the gate 44 is connected to the input of the relay 30 and causes the relay to be turned on and off at the desired rate. The relay 30 causes the electro-luminescent lamp system to be illuminated at the desired rate. The output of the gate 46 is connected to the input of the relay 28 and controls the on/off rate of the relay 28 and the lamp system 6. The output from the gate 48 is connected to the relay 32 and controls the switching of the relay 32. This controls the on and off sequence of the electro-luminescent lamp system 6. The output of the gate 50 is not utilized by the system. It should thus be noted in the preferred embodiment, that a four conductor shielded cable is necessary to handle the lamp signals. It should further be understood that the lamp shields 12 and 14 should be connected together for all the electro-luminescent lamp systems 6 and connected to the electro-luminescent lamp power supply ground 12 as well as the guitar instrument ground. Further, the ground for the inverter 26 is separate from the ground for the 12 volt DC power source in the flasher circuit 36.

Figure 7:
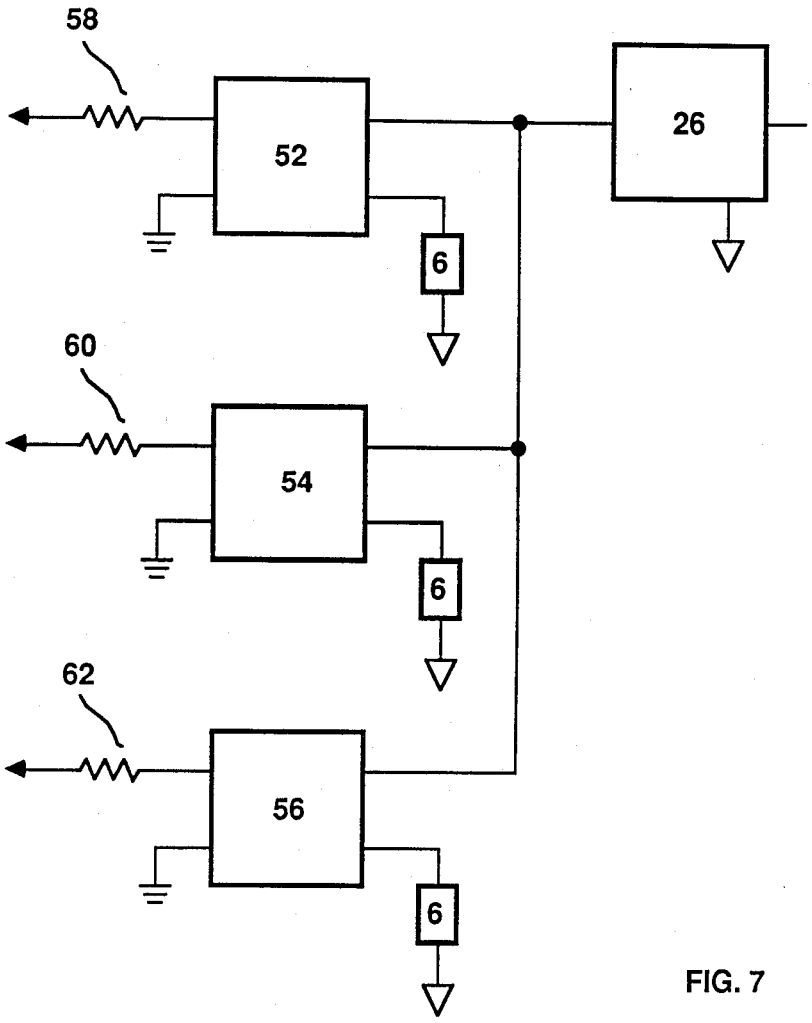
FIG. 7 is an alternate embodiment for the relays of the control circuit of FIG. 4.

Referring now to FIG. 7, an alternate embodiment for the relays 28, 30 and 32 of FIG. 6 is illustrated. The relays 28, 30 and 32 may be replaced with the optocouplers 52, 54 and 56, respectively, such as a Model number DP2110, manufactured by Crydom Corporation. The optocouplers 52, 54 and 56 provide the same switching function as the reed relays 28, 30 and 32 and will generally last longer and provide a faster response time than the reed relays. The optocouplers 52, 54 and 56 are coupled to the outputs of the gates 44, 46 and 48 respectively through current limiting resistors 58, 60 and 62 respectively.

Obviously, numerous (additional) modifications and variations of the present invention are possible in light of the above teachings. For example, frequency discriminator circuits, vibration sensors, and program sequencing, in which a large number of electro-luminescent lamps can be addressed or operated in any desired sequence under micro processor control can also be utilized to accomplish the present invention. It is therefore to be understood that within the scope of the appended claims, the invention may be practiced otherwise than as specifically described herein.

What I claim is:

1. A light system for a musical instrument having an electrical pickup whereby the sound therefrom may be amplified, comprising:

light generating means, connectable to said musical instrument;

shielding means, connected to said light generating means, for attenuating electrical signals from said light generating means whereby interference with said electrical pickup is minimized; and control circuit means, connected to said light generating means, for controlling said light generating means.

2. The system according to claim 1, wherein:

said shielding means includes a glass case which encapsulates said light generating means, said glass case including a layer of electrically conductive material on an inner surface thereof for attenuating electrical signals generated by said light generating means hereby electrical interference with said electrical pickup is minimized.

3. The system according to claim 1, wherein:

said shield means includes two layers of glass with said light generating means sandwiched therebetween, each layer of glass having a layer of electrically conductive material on an inner surface thereof, said two layers of glass being bonded together by an electrically conductive bonding means.

4. The system according to claim 2, wherein:

said electrically conductive material comprises indium-tin oxide.

5. The system according to claim 3, wherein:

said electrically conductive material comprises indium-tin oxide.

6. The system according to claim 1, wherein:

said control circuit means is shielded and is shieldably connected to said light generating means.

7. The system according to claim 1, wherein:

said control circuit means includes means for flashing said light generating means.

8. The system according to claim 1, further comprising:

light concentrating means, connectable to said musical instrument proximate said light generating means, for concentrating light emanating from said light generating means.

9. The system according to claim 8, wherein: said light concentrating means comprises a fresnel lens.

10. The system according to claim 1 wherein:

said light generating means is positionable on said musical instrument to optimally minimize electrical interference with said electrical pickup.

11. The system according to claim 7, wherein:

said means for flashing includes means for varying the flash rate thereof.

12. The system according to claim 11, wherein:

said means for varying the flash rate comprises a foot pedal.

13. The system according to claim 1, wherein:

said control circuit means is shielded and shieldably connected to said light generating means.

14. The system according to claim 13, wherein:

said shielding means including a glass case encapsulating said light generating means, said glass case including a layer of electrically conductive material on an inner surface thereof for providing said attenuation.

15. The system according to claim 14, wherein:

said glass case is formed of two layers, said two layer being bonded together by an electrically conductive bonding means.

16. The system according to claim 14, wherein:

said electrically conductive material is indium-tin oxide.

17. The system according to claim 14, further comprising:

light concentrating means, connected to said body proximate said light generating means, for concentrating the light emanating from said light generating means.

18. The system according to claim 1, wherein:

said musical instrument includes a pick guard, said pick guard having an aperture of a preselected configuration therein; and said light generating means is affixed to a back side of said pick guard in a position to cover said aperture, whereby light emanates from said light generating through said aperture in said pick guard whenever said light generating means is illuminated.

19. The system according to claim 2, wherein:

said electrically conductive material comprises a laminated conductive screen.

20. The system according to claim 2, wherein:

said electrically conductive material comprises a conductive screen cast within a plastic sheet.

21. The system according to claim 2, wherein:

said electrically conductive material comprises a clear conductive layer applied to an optical substrate.

22. The system according to claim 1, wherein:

said shielding means includes a plastic case which encapsulates said light generating means, said plastic case including a layer of electrically conductive material on an inner surface thereof for attenuating electrical signals generated by said light generating means whereby electrical interference with said electrical pickup is minimized.

23. The system according to claim 3, wherein:

said electrically conductive bonding means comprises a conductive busbar made of a conductive coating of paint filled with conductive particles.

24. The system according to claim 3, wherein:

said electrically conductive bonding means comprises a deposited metal film.

25. The system according to claim 3, wherein:

said electrically conductive bonding means comprises a conductive elastomer gasket.

26. The system according to claim 3, wherein:

said electrically conductive bonding means comprises, conductive R.T.V. adhesive.

27. The system according to claim 1, wherein said light generating means comprises an electro-luminescent light generating means.

28. The system according to claim 27, wherein:

said light generating means is positionable on said musical instrument to optimally minimize electrical interference with said electrical pickup.

29. The system according to claim 28, further comprising:

light concentrating means, connected to said body proximate with said generating means, for concentrating the light emanating from said light generating means.

30. The system according to claim 27, wherein:

said shielding means includes a glass case which encapsulates said light generating means, said glass case including a layer of electrically conductive material on an inner surface thereof for attenuating electrical signals generated by said light generating means hereby electrical interference with said electrical pickup is minimized.

31. The system according to claim 27, wherein:

said shielding means includes a plastic case which encapsulates said light generating means, said plastic case including a layer of electrically conductive material on an inner surface thereof for attenuating electrical signals generated by said light generating means whereby electrical interference with said electrical pickup is minimized.

* * * * *